United States Patent [19]

Bakker et al.

[11] 4,250,617

[45] Feb. 17, 1981

[54] SHAVING APPARATUS

[75] Inventors: Eppe Bakker; Pieter Riemersma, both of Drachten, Netherlands

[73] Assignee: U.S. Philips Corporation, New York, N.Y.

[21] Appl. No.: 969,139

[22] Filed: Dec. 13, 1978

[30] Foreign Application Priority Data

Jan. 5, 1978 [NL] Netherlands ..... 7800121

[51] Int. Cl.[3] ..... B26B 19/14; B26B 19/42

[52] U.S. Cl. ..... 30/34.2; 30/43.6

[58] Field of Search ..... 30/34.2, 43.4–43.6

[56] References Cited

U.S. PATENT DOCUMENTS

| | | | |
|---|---|---|---|
| 3,070,884 | 1/1963 | Vaes | 30/34.2 |
| 3,768,160 | 10/1973 | Bergsma | 30/34.2 |
| 3,834,017 | 9/1974 | Tolmie | 30/34.2 |

FOREIGN PATENT DOCUMENTS

| | | | |
|---|---|---|---|
| 2504247 | 8/1975 | Fed. Rep. of Germany | 30/43.6 |

*Primary Examiner*—Gary L. Smith

*Attorney, Agent, or Firm*—Thomas A. Briody; William J. Streeter; Rolf E. Schneider

[57] ABSTRACT

There is provided a shaving apparatus having a holder for at least two and preferably three cutting units arranged in a triangular pattern therein. A raised portion extends over that area of the holder situated centrally with respect to the cutting units, such portion being raised with respect to the periphery of the holder. Desirably such raised portion of the holder gradually slopes downwardly towards the periphery of the holder. An adjustable skin-tautening device is mounted at the periphery of the holder.

2 Claims, 3 Drawing Figures

SHAVING APPARATUS

This invention relates to a shaving apparatus comprising a housing of which a part takes the form of a holder for at least two cutting units, each cutting unit comprising a shear plate and a cutting member which is rotatable relative to the shear plate, a part of a shear plate being provided with hair-entrance apertures and projecting from the holder, which holder is provided with an adjustable skin-tautening device at its periphery.

Such a shaving apparatus is for example known from U.S. Pat. No. 3,992,775.

The adjustable skin-tautening device enables the skin to be tautened to a greater or lesser extent, so that the risk of grazing is reduced and the hairs are oriented more transversely to the skin, which promotes the shaving action. However, the skin-tautening device is located at the periphery of the holder and has no effect on for example that area of the skin which is situated between the two or three cutting units.

The present object of the invention is to eliminate this drawback and this leads to a construction which is characterized in that between the two or three cutting units there is disposed a raised holder portion.

An embodiment which specifically relates to a shaving apparatus having three cutting units arranged in a triangular pattern, is characterized in that the raised portion extends over the holder portion which is situated centrally relative to the three cutting units.

A special embodiment is characterized in that the raised portion of the holder gradually slopes down towards the periphery of the holder.

A preferred embodiment is characterized in that the raised portion of the holder forms part of a fixed tautening rim which is integral with the holder.

The invention will now be described in detail in connection with the accompanying drawings, in which.

Figure 1:
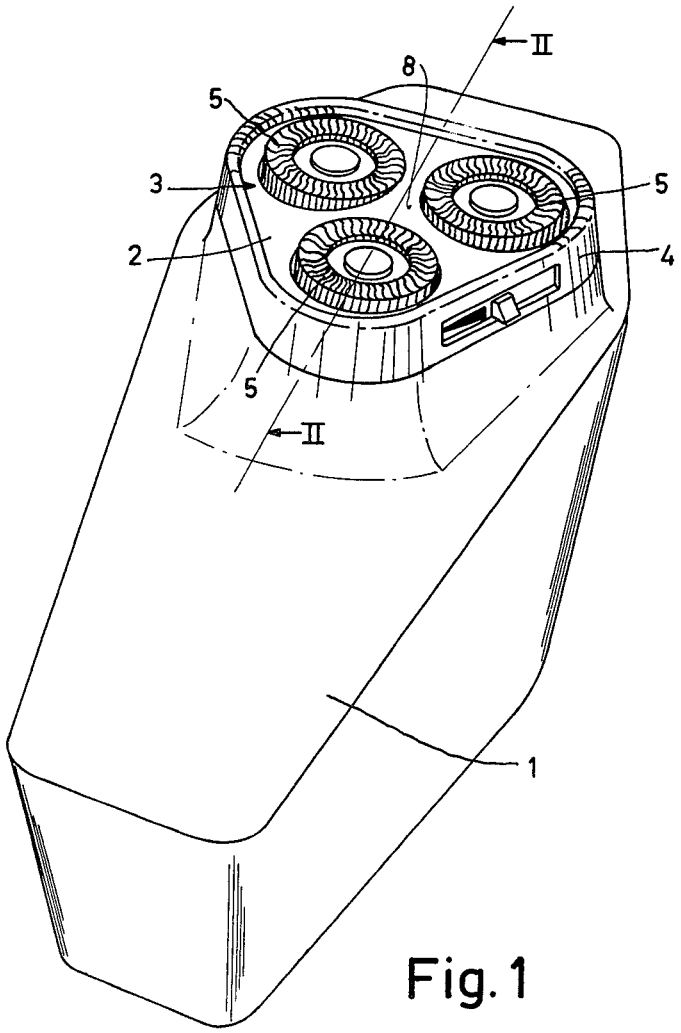
FIG. 1 shows a shaving apparatus with three cutting units in perspective.
Figure 2:
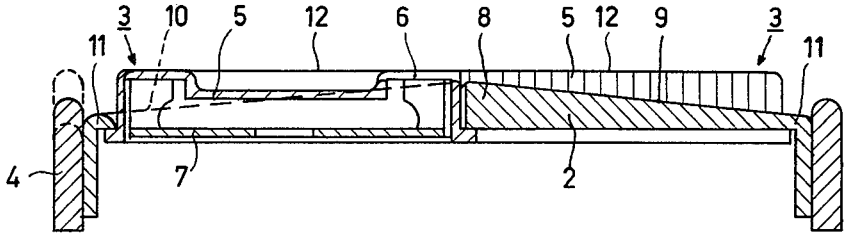
FIG. 2 shows a cross-section through a cutting unit and the holder taken on the line II—II in FIG. 1.

The shaving apparatus in accordance with FIGS. 1 and 2 comprises a housing 1 of which a part takes the form of a holder 2 for three cutting units 3 which are arranged in a triangular pattern. At its circumference or periphery the holder 2 is provided with an adjustable skin-tautening device 4, known per se. Each cutting unit comprises a circular shear plate 5 with hair-entrance apertures 6 and a cutting member 7. The cutting member 7 is drivable relative to the shear plate 5, also in known manner, so that by cooperation of a shear plate and a cutting member a hair which is caught in a hair-entrance aperture 6 is cut. In order to increase the chance of a hair being caught in a hair-entrance aperture and to promote satisfactory contact with the skin, a part of the shear plate in which the hair-entrance apertures 6 are formed projects outwardly from the holder 2 over some distance. Between the cutting units the outwardly raised portion 8 of the holder 2 is located. This raised portion, as indicated by the lines 9 and 10, slopes downwardly towards the peripheral portion 11 of the holder. The raised portion 8 prevents the skin, which locally cannot be tautened by the skin-tautening device, from being trapped between the cutting units. Generally, the raised portion 8 will extend over the entire part of the holder 2 which is centrally disposed relative to the cutting units 3 and will be disposed slightly below the level of the contact faces 12 of the shear plates 5. When the cutting units 3 are resiliently supported and are inwardly movable relative to the holder 2, the raised portion 8 may become flush with the contact faces 12, so that the raised portion 8 also functions as a fixed tautening rim.

As the raised portion 8 slopes downwardly towards the peripheral portion of the holder which adjoins the skin-tautening device 4, the action of this skin-tautening device is not affected. Said skin tautening device 4, which is schematically shown in FIG. 2, is for example adjustable in height between two extreme positions represented by dashed lines.

Figure 3:
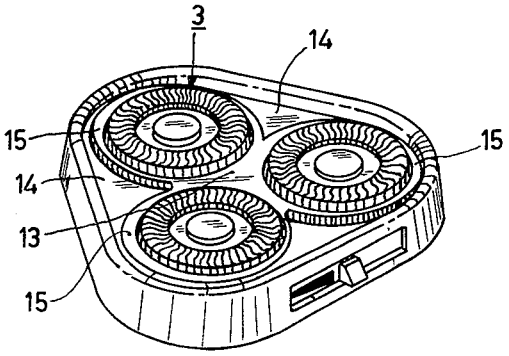
FIG. 3 shows the holder with three cutting units of a different embodiment in perspective.

In the embodiment of FIG. 3 the transition between the raised portion 13 and the peripheral portion 14 of the holder is abrupt. Further, the raised portion 13 continues as a fixed tautening rim 15, which encloses the cutting units 3. The height of this fixed tautening rim also decreases in accordance with the lines 9 and 10 in FIG. 2.

What is claimed is:

1. A shaving apparatus having a holder; three cutting units arranged in a triangular pattern in said holder, each cutting unit comprising a circular shear plate provided with hair entrance apertures and a cutting member associated with and rotatable relative to the shear plate; a raised portion extending over that area of the holder situated centrally relative to the three cutting units, said portion being raised with respect to the periphery of the holder and gradually sloping downwardly towards the periphery of the holder; and a separate adjustable skin-tautening device mounted at the periphery of the holder.

2. A shaving apparatus according to claim 1, in which the raised portion forms part of a fixed tautening rim integral with the holder.

* * * * *